United States Patent [19]

Passal et al.

[11] 4,104,138

[45] Aug. 1, 1978

[54] BRASS PLATING

[75] Inventors: Frank Passal, Royal Oak; Ronald J. Lash, Warren; Otto Kardos, Ferndale, all of Mich.

[73] Assignee: M&T Chemicals Inc., Stamford, Conn.

[21] Appl. No.: 804,468

[22] Filed: Jun. 7, 1977

[51] Int. Cl.[2] ..... C25D 3/58

[52] U.S. Cl. ..... 204/44

[58] Field of Search ..... 204/44, 52 R, 52 Y, 204/55 R, 55 Y, 123

[56] References Cited

U.S. PATENT DOCUMENTS

| | | | |
|---|---|---|---|
| 2,701,234 | 2/1955 | Wernlund | 204/52 Y |
| 2,841,542 | 7/1958 | Manquen | 204/52 Y |
| 2,881,122 | 4/1959 | Foulke et al. | 204/52 Y |
| 2,970,951 | 2/1961 | Manquen et al. | 204/52 Y |
| 3,296,101 | 1/1967 | Crain | 204/44 |
| 3,758,386 | 9/1973 | Chan | 204/55 R |
| 3,878,069 | 4/1975 | Todt | 204/55 R |

*Primary Examiner*—G. L. Kaplan

*Attorney, Agent, or Firm*—Kenneth G. Wheeless; Robert Spector

[57] ABSTRACT

The novel process of this invention for electroplating a bright brass onto basis metal comprises passing current from an anode to a basis metal cathode through an aqueous alkaline cyanide plating solution containing:

at least one copper compound providing copper ions and at least one zinc compound providing zinc ions and as cooperating additives a salt of a condensed arylsulfonic acid and a free aldehyde or its bisulfite adduct.

11 Claims, No Drawings

BRASS PLATING

This invention relates to a combination of additives for the electrodeposition of semi-bright to bright uniform brass deposits. More particularly this invention relates to additives for the electrodeposition of bright uniform brass deposits having an alloy composition of 45% to 65% copper.

Brass deposits have heretofore been limited to a narrow alloy composition in order to maintain adequate brightness and coverage. It is an object of this invention to provide a combination of additives that improves or maintains brightness and coverage over a wider range of alloy composition and current density.

The novel process of this invention for electroplating a bright brass onto basis metal comprises passing current from an anode to a basis metal cathode through an aqueous alkaline cyanide plating solution containing:

at least one copper compound providing copper ions and at least one zinc compound providing zinc ions and as cooperating additives a salt of a condensed arylsulfonic acid and a free aldehyde or its bisulfite adduct.

Practice of this invention results in a semi-bright to bright deposit with a wide current density range. The novel additives of this invention also eliminate the problem of maintaining the alloy composition within narrow limits in order to preserve uniformity and coverage. Also practice of this invention eliminates dull or non-reflective extreme low current density areas which occur as bands at the low end of a Hull Cell test panel.

A typical bath which may be used in practice of this invention may include the following components in aqueous solution, all values being in grams per liter:

| Component | Minimum g/l | Maximum g/l | Preferred |
|---|---|---|---|
| Sodium Cyanide | | | 1.3 to 1.4X Total Metal |
| Caustic Soda | 22 | 37 | 30 |
| Copper Metal | 11 | 26 | 15–20 |
| Zinc Metal | 11 | 26 | 14–18 |

In the above components copper is added as sodium copper (I) cyanide and zinc as zinc cyanide.

The cooperating condensation product of an arylsulfonic acid may be present in the brass plating solution from 0.1 gram per liter to 10 grams per liter, preferably from 0.5 to 2.0 grams per liter. The cooperating aldehyde or aldehyde bisulfite adduct may be present from 0.1 gram per liter to 2.0 grams per liter, preferably from 0.4 to 0.8 grams per liter.

The specific arylsulfonic acid salts which may be used are: condensing polymers of formaldehyde and naphthalene sulfonic acid, the simplest representative of which is methylene bis-(naphthalene) sulfonic acid sodium salt. Such compounds are commercially available or may be prepared as the condensation product of naphthalene sulfonic acid and formaldehyde.

Typical aldehydes which may be used singly or in combination are benzaldehyde, 4-methoxybenzaldehyde, 2-methoxybenzaldehyde, crotonaldehyde, cinnamaldehyde, 4-hydroxy-3-methoxybenzaldehyde, 2-furaldehyde, and sorbic aldehyde.

For the purpose of providing those skilled in the art with a better understanding of this invention, the following examples are set forth wherein all parts are parts by weight unless otherwise specified.

EXAMPLE I

A brass bath was prepared having the following make-up composition:

| | oz/gal. | g/l |
|---|---|---|
| Copper (I) Cyanide | 3.9 | 29 |
| Zinc Cyanide | 3.7 | 28 |
| Sodium Cyanide | 7.7 | 58 |
| Sodium Hydroxide | 4.0 | 30 |
| *Sodium Sulfide | 0.025 | 0.2 |

*Used as a purifier.

A Hull Cell test was run under the following conditions:

| | |
|---|---|
| Solution Volume | 1000 ml |
| Agitation | air on anode |
| Anode | brass (48% Cu, 52% Zn) |
| Cathode | polished steel |
| Temperature | 24° C |
| Current | 3 amperes |
| Time | 15 minutes |

The resulting deposit without additives is dull and non-uniform in the range below 9 asd.

EXAMPLE II

The test of Example I was repeated with the addition of 1 gram per liter of the sodium salt of methylene bis-(naphthalene) sulfonic acid. The resulting brass deposit is bright and uniform in the current density range of 9 asd to 0.6 asd. Below 0.6 asd there was obtained a dull band with coarse grained, non-reflective surface characteristics.

EXAMPLE III

The test of Example II was repeated with the addition of 0.6 gram per liter of para-methoxybenzaldehyde (p-Anisicaldehyde). The resulting brass deposit was bright and uniform in the current density range 9 asd to less than 0.06 asd.

EXAMPLE IV

A brass bath was prepared having the following composition:

| | oz/gal. | g/l |
|---|---|---|
| Copper Cyanide | 3.3 | 25 |
| Zinc Oxide | 2.7 | 20 |
| Sodium Cyanide | 9.7 | 73 |
| Sodium Hydroxide | 2.7 | 20 |
| *Sodium Sulfide | 0.025 | 0.2 |
| Crotonaldehyde | 0.06 | 0.5 |
| Methylene Bis-(naphthalene) sulfonic acid sodium salt | 0.13 | 1.0 |

*Used as purifier.

The resulting brass deposit was fully bright in the current density range below 9 asd. Other aldehydes found to be effective include benzaldehyde, 2-methoxybenzaldehyde, cinnamaldehyde, 4-hydroxy-3-methoxybenzaldehyde, 2-furaldehyde, and sorbic aldehyde.

While this invention has been illustrated with specific examples, the scope is limited only by the claims.

What is claimed is:

1. A process for electroplating bright brass onto basis metal comprising passing current from an anode to a basis metal cathode through an aqueous alkaline cyanide plating solution containing:

at least one copper compound providing 11 to 26 g/l of copper ions, at least one zinc compound providing 11 to 26 g/l of zinc ions, and as cooperating additives 0.1 to 10 g/l of at least one salt of a condensed arylsulfonic acid and 0.1 to 2 g/l of at least one aldehyde or its bisulfite adduct.

2. The process of claim 1 wherein said condensed arylsulfonic acid is methylene bis-(naphthalene) sulfonic acid.

3. The process of claim 1 wherein said aldehyde is benzaldehyde.

4. The process of claim 1 wherein said aldehyde is 4-methoxybenzaldehyde.

5. The process of claim 1 wherein said aldehyde is 2-methoxybenzaldehyde.

6. The process of claim 1 wherein said aldehyde is crotonaldehyde.

7. The process of claim 1 wherein said aldehyde is cinnamaldehyde.

8. The process of claim 1 wherein said aldehyde is 4-hydroxy-3-methoxybenzaldehyde.

9. The process of claim 1 wherein said aldehyde is 2-furaldehyde.

10. The process of claim 1 wherein said aldehyde is sorbic aldehyde.

11. A composition for electroplating bright brass having an alloy composition of from 45% to 65% copper comprising an aqueous alkaline cyanide electroplating solution containing:

at least one copper compound providing 11 to 26 g/l of copper ions, at least one zinc compound providing 11 to 26 g/l of zinc ions, 0.1 to 10 g/l of a salt of at least one condensed arylsulfonic acid, and 0.1 to 2 g/l of at least one aldehyde or the bisulfite adduct of at least one aldehyde.

* * * * *